US009127567B2

(12) United States Patent
Motto

(10) Patent No.: US 9,127,567 B2
(45) Date of Patent: Sep. 8, 2015

(54) NON-INTERRUPTED TURBOMACHINE FLUID SUPPLY

(75) Inventor: David L. Motto, Ellington, CT (US)

(73) Assignee: United Technologies Corporation, Hartford, CT (US)

( * ) Notice: Subject to any disclaimer, the term of this patent is extended or adjusted under 35 U.S.C. 154(b) by 708 days.

(21) Appl. No.: 13/538,024

(22) Filed: Jun. 29, 2012

(65) Prior Publication Data

US 2014/0003906 A1 Jan. 2, 2014

(51) Int. Cl.

*F01D 25/18* (2006.01)
*F01D 15/12* (2006.01)
*F01M 11/06* (2006.01)

(52) U.S. Cl.

CPC ..... *F01D 25/18* (2013.01); *F01M 11/067* (2013.01)

(58) Field of Classification Search

CPC ..... F01D 25/18; F01D 25/20; F01D 15/12; F02C 7/06
USPC ..... 415/1, 122.1, 144; 416/170 R; 184/6.11, 184/39, 55.2
See application file for complete search history.

(56) References Cited

U.S. PATENT DOCUMENTS

| | | | | |
|---|---|---|---|---|
| 3,321,910 | A | 5/1967 | Davies et al. | |
| 4,390,082 | A | 6/1983 | Swearingen | |
| 4,569,196 | A | 2/1986 | Waddington et al. | |
| 4,697,414 | A | 10/1987 | McCarty | |
| 4,741,155 | A | 5/1988 | McCarty | |
| 5,004,407 | A | 4/1991 | Hutchison | |
| 5,377,216 | A | 12/1994 | Nilsen et al. | |
| 6,267,147 | B1 | 7/2001 | Rago | |
| 7,216,473 | B1 | 5/2007 | McArthur et al. | |
| 7,303,713 | B2 | 12/2007 | Gabriel et al. | |
| 8,567,564 | B2 * | 10/2013 | Norris | 184/6.11 |
| 2006/0075754 | A1 | 4/2006 | Champion et al. | |
| 2009/0235630 | A1 | 9/2009 | Norris | |
| 2010/0028127 | A1 | 2/2010 | Cornet et al. | |
| 2011/0108360 | A1 | 5/2011 | DiBenedetto | |

FOREIGN PATENT DOCUMENTS

| | | |
|---|---|---|
| EP | 2559913 | 2/2013 |
| WO | 02-35064 | 5/2002 |

OTHER PUBLICATIONS

International Preliminary Report on Patentability for PCT Application No. PCT/US2013/043994, mailed Jan. 8, 2014.
International Search Report and Written Opinion for International Application No. PCT/US2013/043994 dated Mar. 17, 2014.

* cited by examiner

*Primary Examiner* — Edward Look
*Assistant Examiner* — Jesse Prager
(74) *Attorney, Agent, or Firm* — Carlson, Gaskey & Olds, P.C.

(57) ABSTRACT

An exemplary fluid supply system for use on a turbomachine includes a turbomachine fluid container having a moveable barrier. A pressurized fluid is delivered to one side of the moveable barrier, and an opposing side of the flexible barrier communicates with a source of lubricant. Pressurized fluid is selectively delivered to the one side to move the moveable barrier between a flow-permitting position that permits flow from the source of lubricant to the turbomachine fluid container and a flow-restricting position that restricts flow from the source of lubricant to the turbomachine fluid container.

19 Claims, 3 Drawing Sheets

NON-INTERRUPTED TURBOMACHINE FLUID SUPPLY

BACKGROUND

This disclosure relates generally to a fluid supply and, more particularly, to turbomachine fluid supply that provides non-interrupted flow during positive g-force flight conditions and negative g-force flight conditions.

Turbomachines, such as gas turbine engines, typically include a fan section, a compression section, a combustion section, and a turbine section. Turbomachines may employ a geared architecture connecting portions of the compression section to the turbine section.

Turbomachines may be used to propel an aircraft in flight, for example. The g-forces acting on the turbomachine are typically positive when the aircraft is in flight. Occasionally, the g-forces acting on the turbomachine are negative when the aircraft is in flight. Some areas of the turbomachine require a relatively non-interrupted supply of lubricant. These areas must receive lubricant when positive g-forces act on the turbomachine and when negative g-forces act on the turbomachine.

SUMMARY

A fluid supply system for use on a turbomachine according to an exemplary aspect of the present disclosure includes, among other things, turbomachine fluid container having a moveable barrier, with a pressurized fluid delivered to one side of the moveable barrier, and an opposing side of the moveable barrier communicating with a source of lubricant. The pressurized fluid is selectively delivered to the one side to move the moveable barrier between a flow-permitting position that permits flow from the source of lubricant to the turbomachine fluid container and a flow-restricting position that restricts flow from the source of lubricant to the turbomachine fluid container.

In a further non-limiting embodiment of the foregoing fluid supply system, the moveable barrier may comprise a flexible barrier.

In a further non-limiting embodiment of either of the foregoing fluid supply systems, the moveable barrier may comprise a piston.

In a further non-limiting embodiment of any of the foregoing fluid supply systems, a spring may be configured to move the moveable barrier from the flow-restricting position to the flow-permitting position.

In a further non-limiting embodiment of any of the foregoing fluid supply systems, the moveable barrier may be a bag-like member.

In a further non-limiting embodiment of any of the foregoing fluid supply systems, a solenoid valve may be configured to selectively deliver the pressurized fluid to the one side in response to a transition of a turbomachine from a positive g-force environment to a negative g-force environment.

In a further non-limiting embodiment of any of the foregoing fluid supply systems, the pressurized fluid may be selectively delivered to the one side to move a vent of the turbomachine fluid container between a vent-permitted position that permits venting from the turbomachine fluid container and a vent-restricted position that restricts venting from the turbomachine fluid container.

In a further non-limiting embodiment of any of the foregoing fluid supply systems, the pressurized fluid may be selectively delivered to a valve to move a vent of the turbomachine fluid container between a vent-permitted position that permits venting from the turbomachine fluid container and a vent-restricted position that restricts venting from the turbomachine fluid container.

A geared architecture and oil supply system for a turbomachine according to an exemplary aspect of the present disclosure includes, among other things, a geared architecture, a holding container having a flexible barrier, a connection to a source of pressurized fluid to be delivered to one side of the flexible barrier, and an opposing side of the flexible barrier communicating with a source of oil, for delivering oil downstream to a pump. The pressurized fluid is selectively delivered to the one side to move the moveable barrier between a flow-permitting position that permits flow from the source of oil to the holding container and a flow-restricting position that restricts flow from the source of oil to the holding container.

In a further non-limiting embodiment of the foregoing geared architecture and oil supply system, the source of oil may be the geared architecture.

In a further non-limiting embodiment of either of the foregoing geared architecture and oil supply systems, the pressurized fluid may be communicated from a compressor system of the turbomachine.

In a further non-limiting embodiment of any of the foregoing geared architecture and oil supply systems, the pump may deliver the oil to the geared architecture.

In a further non-limiting embodiment of any of the foregoing geared architecture and oil supply systems, a solenoid valve may be configured to selectively deliver the pressurized fluid to the one side in response to a change of a turbomachine from a positive g-force environment to a negative g-force environment.

In a further non-limiting embodiment of any of the foregoing geared architecture and oil supply systems, the pressurized fluid may be selectively delivered to the one side to move the moveable barrier between a vent-permitting position that permits venting from the turbomachine fluid container and a vent-restricting position that restricts venting from the turbomachine fluid container.

In a further non-limiting embodiment of any of the foregoing geared architecture and oil supply systems, the pressurized fluid may be selectively delivered to a valve to move a vent between a vent-permitting position that permits venting from the turbomachine fluid container and a vent-restricting position that restricts venting from the turbomachine fluid container.

A method of maintaining positive suction head on a turbomachine fluid in positive g-force environments and negative g-force environments, according to another exemplary aspect of the present disclosure includes, among other things selectively introducing a compressed fluid to a holding container to move a flexible barrier against an oil within the holding container and to cover an inlet that introduces oil to the holding container. The method includes pumping oil from the holding container.

In a further non-limiting embodiment of the foregoing method of maintaining positive suction head on a turbomachine fluid, the compressed fluid may be compressed by a compression section of a turbomachine.

In a further non-limiting embodiment of either of the foregoing methods of maintaining positive suction head on a turbomachine fluid, the method may include delivering the oil to a geared architecture of a turbomachine.

In a further non-limiting embodiment of any of the foregoing methods of maintaining positive suction head on a turbomachine fluid, the method may include introducing oil to the holding container from a geared architecture of a turbomachine.

DESCRIPTION OF THE FIGURES

The various features and advantages of the disclosed examples will become apparent to those skilled in the art from the detailed description. The figures that accompany the detailed description can be briefly described as follows.

DETAILED DESCRIPTION

Figure 1:
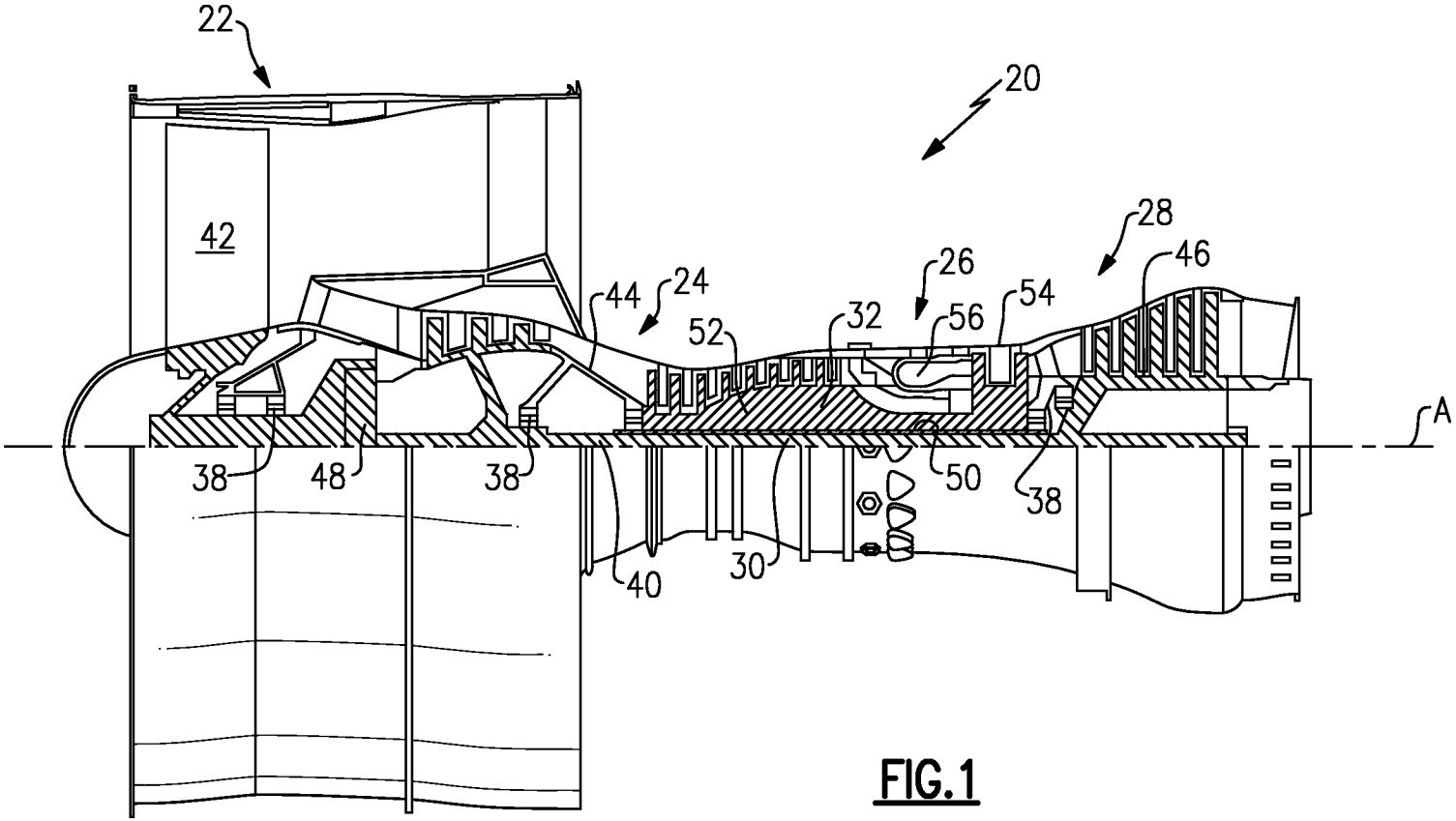
FIG. 1 shows a schematic view of an example turbomachine.

FIG. 1 schematically illustrates an example turbomachine, which is a gas turbine engine 20 in this example. The gas turbine engine 20 is a two-spool turbofan gas turbine engine that generally includes a fan section 22, a compression section 24, a combustion section 26, and a turbine section 28.

Although depicted as a two-spool turbofan gas turbine engine in the disclosed non-limiting embodiment, it should be understood that the concepts described herein are not limited to use with turbofans. That is, the teachings may be applied to other types of turbomachines and turbine engines including three-spool architectures. Further, the concepts described herein could be used in environments other than a turbomachine environment and in applications other than aerospace applications, such as automotive applications.

In the example engine 20, flow moves from the fan section 22 to a bypass flowpath. Flow from the bypass flowpath generates forward thrust. The compression section 24 drives air along the core flowpath. Compressed air from the compression section 24 communicates through the combustion section 26. The products of combustion expand through the turbine section 28.

The example engine 20 generally includes a low-speed spool 30 and a high-speed spool 32 mounted for rotation about an engine central axis A. The low-speed spool 30 and the high-speed spool 32 are rotatably supported by several bearing systems 38. It should be understood that various bearing systems 38 at various locations may alternatively, or additionally, be provided.

The low-speed spool 30 generally includes a shaft 40 that interconnects a fan 42, a low-pressure compressor 44, and a low-pressure turbine 46. The shaft 40 is connected to the fan 42 through a geared architecture 48 to drive the fan 42 at a lower speed than the low-speed spool 30.

The high-speed spool 32 includes a shaft 50 that interconnects a high-pressure compressor 52 and high-pressure turbine 54.

The shaft 40 and the shaft 50 are concentric and rotate via bearing systems 38 about the engine central longitudinal axis A, which is collinear with the longitudinal axes of the shaft 40 and the shaft 50.

The combustion section 26 includes a circumferentially distributed array of combustors 56 generally arranged axially between the high-pressure compressor 52 and the high-pressure turbine 54.

In some non-limiting examples, the engine 20 is a high-bypass geared aircraft engine. In a further example, the engine 20 bypass ratio is greater than about six (6 to 1).

The geared architecture 48 of the example engine 20 includes an epicyclic gear train, such as a planetary gear system or other gear system. The example epicyclic gear train has a gear reduction ratio of greater than about 2.3 (2.3 to 1).

The low-pressure turbine 46 pressure ratio is pressure measured prior to inlet of low-pressure turbine 46 as related to the pressure at the outlet of the low-pressure turbine 46 prior to an exhaust nozzle of the engine 20. In one non-limiting embodiment, the bypass ratio of the engine 20 is greater than about ten (10 to 1), the fan diameter is significantly larger than that of the low pressure compressor 44, and the low-pressure turbine 46 has a pressure ratio that is greater than about 5 (5 to 1). The geared architecture 48 of this embodiment is an epicyclic gear train with a gear reduction ratio of greater than about 2.5 (2.5 to 1). It should be understood, however, that the above parameters are only exemplary of one embodiment of a geared architecture engine and that the present disclosure is applicable to other gas turbine engines including direct drive turbofans.

In this embodiment of the example engine 20, a significant amount of thrust is provided by the bypass flow B due to the high bypass ratio. The fan section 22 of the engine 20 is designed for a particular flight condition—typically cruise at about 0.8 Mach and about 35,000 feet. This flight condition, with the engine 20 at its best fuel consumption, is also known as "Bucket Cruise" Thrust Specific Fuel Consumption (TSFC). TSFC is an industry standard parameter of fuel consumption per unit of thrust.

Fan Pressure Ratio is the pressure ratio across a blade of the fan section 22 without the use of a Fan Exit Guide Vane system. The low Fan Pressure Ratio according to one non-limiting embodiment of the example engine 20 is less than 1.45 (1.45 to 1).

Low Corrected Fan Tip Speed is the actual fan tip speed divided by an industry standard temperature correction of Temperature divided by 518.7^0.5. The Temperature represents the ambient temperature in degrees Rankine. The Low Corrected Fan Tip Speed according to one non-limiting embodiment of the example engine 20 is less than about 1150 fps (351 m/s).

Figure 2:
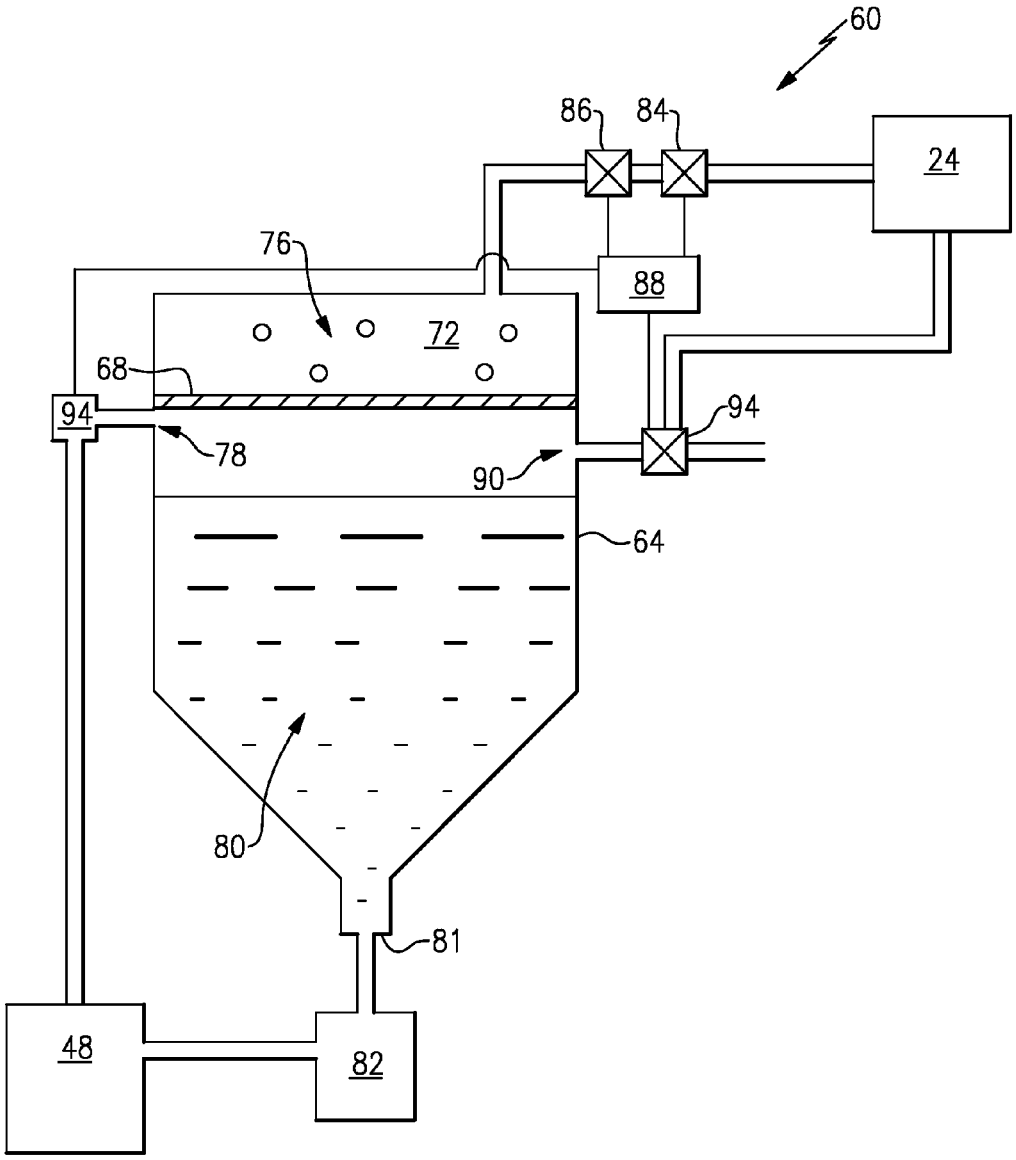
FIG. 2 shows, in a positive g-force environment, an example fluid supply system that supplies a fluid to the turbomachine of FIG. 1.
Figure 3:
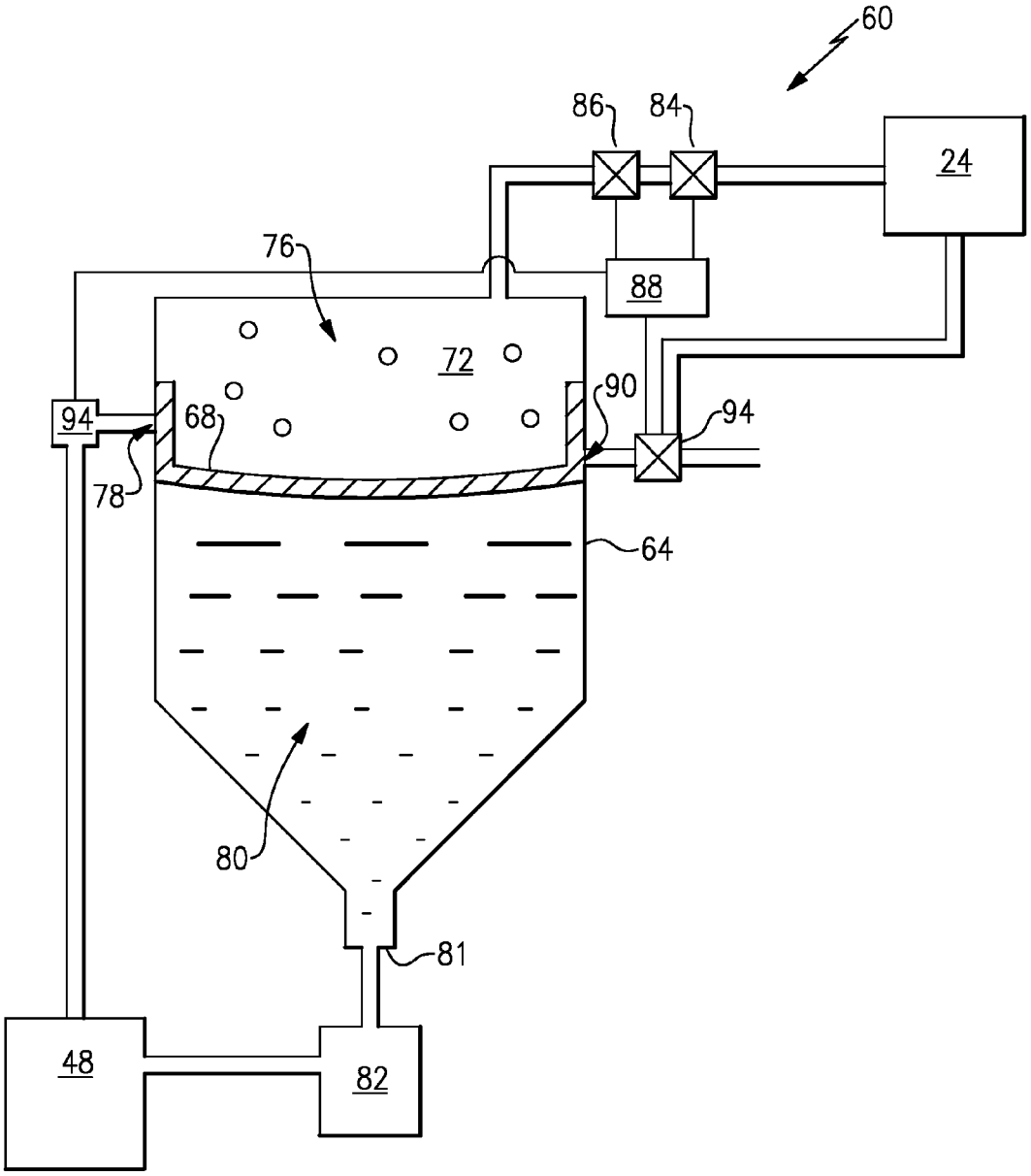
FIG. 3 shows, in a negative g-force environment, the fluid supply system of FIG. 2.

Referring to FIGS. 2 and 3 with continuing reference to FIG. 1, an example fluid supply system 60 provides a turbomachine fluid, such as oil, to the geared architecture 48 of the engine 20. The fluid supply system 60 and the geared architecture 48 together provide a geared architecture and oil supply system.

The example fluid supply system includes a turbomachine fluid container 64 or holding container. The turbomachine fluid container 64 contains a moveable barrier 68. A pressurized fluid 72 is delivered from a pressurized fluid supply to one side 76 of the moveable barrier 68. A lubricant is selectively delivered to an opposing side 80 of the moveable barrier 68 based on the position of the moveable barrier 68. The lubricant moves through an inlet 78 to the turbomachine fluid container 64, and then from an outlet 81 of the container 64 to the geared architecture 48. The lubricant thus circulates between the geared architecture 48 and the opposing side 80 when the inlet 78 is open. The example fluid supply system 60 includes a pump 82 that draws the lubricant from the container 64 and delivers the lubricant to the geared architecture 48 of the engine 20.

In this example, the pressurized fluid supply is bleed air from the compression section 24 of the engine 20. A valve 84, a pressure regulator 86, or both may be used to selectively deliver the pressurized fluid 72 to the turbomachine fluid container 64. The valve 84, the pressure regulator 86, or both may be linked to a controller 88, which changes the amount of pressurized fluid 72 delivered to the turbomachine fluid container 64 in response to a transition of the engine 20 from a positive g-force environment to a negative g-force environment.

When sufficient pressurized fluid 72 is delivered to the one side 76, the moveable barrier 68 moves from a flow-permitting position (FIG. 2) to a flow-restricting position (FIG. 3). The moveable barrier 68 in the flow-permitting position permits more flow through the inlet 78 than the moveable barrier 68 in the flow-restricting position. In some examples, the moveable barrier 68 completely blocks flow through the inlet 78 when the moveable barrier 68 is in the flow-restricting position.

Moving the moveable barrier 68 when the engine 20 transitions from the positive g-force environment to the negative g-force environment limits movement of the oil away from the outlet 81 to maintain a positive suction head at the outlet 81. Using information from the pressure regulator 86 the controller 88 may manipulate the valve 84 to deliver enough pressurized fluid 72 to the one side 76 to keep the moveable barrier 68 at position suitable for maintaining the positive suction head under all operating conditions, including negative g-force operations.

Any suitable type of sensor may be used to determine the type of g-forces acting on the engine 20. A person having skill in this art and having the benefit of this disclosure would understand how to collect such g-force information and communicate such information to the controller 88.

The example valve 84, pressure regulator 86, and controller 88 may quickly deliver pressurized fluid 72 to the one side 76 if the engine 20 has a relatively hard transition to a negative g-force environment. If the engine 20 instead has a relatively soft transition, the valve 84, pressure regulator 86, and controller 88 may slowly deliver pressurized fluid 72 to the one side 76. In some examples, the container 64 includes a vent 90 that selectively communicates fluid, such as air or oil, from the container 64. The controller 88 may manipulate the position of a valve 94 to control venting of fluid through the vent 90. The valve 94 is moveable between a vent-permitted position and a vent-restricted position. Pressurized fluid from the compression section 24 may be used to manipulate the position of the valve 94.

The moveable barrier 68 also may move over the vent 90 to block venting of fluid through the vent 90. Pressurized fluid 72 delivered to the one side 76 may be used to position the moveable barrier 68 over the vent 90 instead of, or in addition to, being positioned over the inlet 78. When the moveable barrier 68 covers the vent 90 the vent 90 is in the vent-restricted position. The vent 90 is in the vent-permitted position when the moveable barrier 68 does not cover the vent 90.

Covering the vent 90 prevents fluid (oil) from escaping from the container 64 in negative g-force environments. Alternatively, when a negative f-force environment is recognized, the valve 94 may block oil, an oil/air mixture, etc. from escaping. The vent 90 may allow air to escape from the container 64 in positive g-force environments.

In one specific example of the fluid supply system 60, the vent 90 is in the vent-permitted position when the engine 20 is not operating and when the engine 20 is windmilling, but not in flight. The vent 90 in the vent-permitted position allows oil to be suctioned out of the container 64 without using a scavenge pump. When the engine 20 begins to operate, the controller 88 actuates the valve 94 to substantially close the vent 90 to atmosphere. The vent 90 is then in the vent-restricted position. The controller 88 also delivers pressurized fluid to the one side 76 when the engine 20 begins to operate. In the negative g-force environment, the controller 88 delivers enough pressurized fluid to the one side 76 to maintain positive suction head at the outlet 81.

In another specific example of the fluid supply system 60, the vent 90 is in the vent-permitted position when the engine 20 is not operating and when the engine 20 is windmilling, but not in flight. The vent 90 in the vent-permitted position allows oil to be suctioned out of the container 64 without using a scavenge pump. In this example, when the engine 20 begins to operate, the controller 88 delivers pressurized fluid to the one side 76 to move the moveable barrier 68 to a position where the moveable barrier 68 blocks the vent Or the valve to the vent closes 90. The vent 90, when blocked by the moveable barrier 68, is in the vent-restricted position. In the negative g-force environment, the controller 88 delivers enough pressurized fluid to the one side 76 to maintain positive suction head at the outlet 81.

The example fluid supply system 60 may include a sensor 94 at or near the inlet 78. The sensor 89 is operatively connected to the controller 88. The sensor 89 reveals the pressure at the inlet 78. The controller 88 thus receives information about pressures on both sides of the moveable barrier 68, which facilitates balancing the pressures on either side of the barrier 68.

In some examples, the moveable barrier 68 is a flexible barrier, such as an inflatable bag. The moveable barrier 68 may have folds and have an accordion-like construction. In other examples, the moveable barrier 68 is a piston-type barrier. A spring may be used to return the moveable barrier 68 from the flow-restricting position to the flow-permitting position.

The preceding description is exemplary rather than limiting in nature. Variations and modifications to the disclosed examples may become apparent to those skilled in the art that do not necessarily depart from the essence of this disclosure. Thus, the scope of legal protection given to this disclosure can only be determined by studying the following claims.

I claim:

1. A fluid supply system for use on a turbomachine, comprising:

a turbomachine fluid container having a moveable barrier, with a pressurized fluid delivered to one side of the moveable barrier, and an opposing side of the moveable barrier communicating with a source of lubricant, wherein pressurized fluid is selectively delivered to the one side to move the moveable barrier between a flow-permitting position that permits flow from the source of lubricant to the turbomachine fluid container and a flow-restricting position that restricts flow from the source of lubricant to the turbomachine fluid container.

2. The fluid supply system of claim 1, wherein the moveable barrier comprises a flexible barrier.

3. The fluid supply system of claim 1, wherein the moveable barrier comprises a piston.

4. The fluid supply system of claim 1, including a spring configured to move the moveable barrier from the flow-restricting position to the flow-permitting position.

5. The fluid supply system of claim 1, wherein the moveable barrier is a bag-like member.

6. The fluid supply system of claim 1, including a solenoid valve configured to selectively deliver the pressurized fluid to the one side in response to a transition of a turbomachine from a positive g-force environment to a negative g-force environment.

7. The fluid supply system of claim 1, wherein the pressurized fluid is selectively delivered to the one side to move a vent of the turbomachine fluid container between a vent-permitted position that permits venting from the turbomachine fluid container and a vent-restricted position that restricts venting from the turbomachine fluid container.

8. The fluid supply system of claim 1, wherein the pressurized fluid is selectively delivered to a valve to move a vent of the turbomachine fluid container between a vent-permitted position that permits venting from the turbomachine fluid container and a vent-restricted position that restricts venting from the turbomachine fluid container.

9. A geared architecture and oil supply system for a turbomachine comprising:

a geared architecture;

a holding container having a flexible barrier, with a connection to a source of pressurized fluid to be delivered to one side of the flexible barrier, and an opposing side of the flexible barrier communicating with a source of oil, for delivering oil downstream to a pump; and wherein pressurized fluid is selectively delivered to the one side to move the moveable barrier between a flow-permitting position that permits flow from the source of oil to the holding container and a flow-restricting position that restricts flow from the source of oil to the holding container.

10. The system of claim 9, wherein the source of oil is the geared architecture.

11. The system of claim 9, wherein the pressurized fluid is communicated from a compressor system of a turbomachine.

12. The system of claim 9, wherein the pump delivers the oil to the geared architecture.

13. The system of claim 9, including a solenoid valve configured to selectively deliver the pressurized fluid to the one side in response to a change of a turbomachine from a positive g-force environment to a negative g-force environment.

14. The system of claim 9, wherein the pressurized fluid is selectively delivered to the one side to move the moveable barrier between a vent-permitted position that permits venting from the turbomachine fluid container and a vent-restricted position that restricts venting from the turbomachine fluid container.

15. The system of claim 9, wherein the pressurized fluid is selectively delivered to a valve to move a vent between a vent-permitting position that permits venting from the turbomachine fluid container and a vent-restricting position that restricts venting form the turbomachine fluid container.

16. A method of maintaining positive suction head on a turbomachine fluid in positive g-force environments and negative g-force environments, comprising:

selectively introducing a compressed fluid to a holding container to move a flexible barrier against an oil within the holding container, and to cover an inlet that introduces oil to the holding container; and pumping oil from the holding container.

17. The method of claim 16, wherein the compressed fluid is compressed by a compression section of a turbomachine.

18. The method of claim 16, including delivering the oil to a geared architecture of a turbomachine.

19. The method of claim 18, including introducing oil to the holding container from a geared architecture of a turbomachine.

* * * * *

UNITED STATES PATENT AND TRADEMARK OFFICE

CERTIFICATE OF CORRECTION

PATENT NO. : 9,127,567 B2
APPLICATION NO. : 13/538024
DATED : September 8, 2015
INVENTOR(S) : David L. Motto It is certified that error appears in the above-identified patent and that said Letters Patent is hereby corrected as shown below:

IN THE CLAIMS:

In claim 15, column 8, line 11; delete "form" and replace with --from--

Signed and Sealed this
Fifth Day of July, 2016

Michelle K. Lee

Michelle K. Lee
*Director of the United States Patent and Trademark Office*